United States Patent [19]

Wacker et al.

[11] 4,194,729

[45] Mar. 25, 1980

[54] SINTERING WITH EXHAUST GAS PIPES

[75] Inventors: Karl Wacker, Hanau am Main; Fritz Feigk, Langen, both of Fed. Rep. of Germany

[73] Assignee: Dravo Corporation, Pittsburgh, Pa.

[21] Appl. No.: 956,058

[22] Filed: Oct. 30, 1978

[30] Foreign Application Priority Data

Dec. 16, 1977 [DE] Fed. Rep. of Germany ..... 2756082

[51] Int. Cl.[2] ..... C22B 1/20; C22B 1/26; F27B 9/04

[52] U.S. Cl. ..... 266/144; 75/5; 266/159; 266/178; 432/133

[58] Field of Search ..... 75/3, 4, 5; 266/144, 266/159, 178, 179, 180; 432/61, 78, 133

[56] References Cited

U.S. PATENT DOCUMENTS

| | | | |
|---|---|---|---|
| 2,441,383 | 5/1948 | Babb | 266/159 |
| 2,763,479 | 9/1956 | Huisken et al. | 266/180 |
| 2,987,307 | 6/1961 | Homan | 75/5 |
| 3,635,003 | 1/1972 | Schindling | 266/178 |
| 3,744,778 | 7/1973 | Buhner | 266/178 |
| 3,816,096 | 6/1974 | Tsujihata | 75/5 |
| 3,831,911 | 4/1974 | Dorville | 266/21 |
| 3,949,974 | 4/1976 | Schiokawa et al. | 266/178 |

FOREIGN PATENT DOCUMENTS

| | | |
|---|---|---|
| 2020823 | 12/1972 | Fed. Rep. of Germany . |
| 2158317 | 1/1975 | Fed. Rep. of Germany . |
| 2,321,213 | 6/1975 | Fed. Rep. of Germany . |
| 2520957 | 11/1976 | Fed. Rep. of Germany . |
| 2612831 | 1/1977 | Fed. Rep. of Germany . |
| 1427089 | 3/1976 | United Kingdom . |

*Primary Examiner*—L. Dewayne Rutledge
*Assistant Examiner*—Michael L. Lewis
*Attorney, Agent, or Firm*—Parmelee, Miller, Welsh & Kratz

[57] ABSTRACT

A sintering plant in which sinter exhaust gases and cooling gases are collected in separate gas collecting systems. A cooling gas gas-collecting main is located beneath the lower strand of a sintering belt and is connected to opposite sides of each of the wind boxes underlying the cooling section of the sintering strand by at least two cooling gas connecting pipes, and at least one sinter exhaust gas gas-collecting main is disposed adjacent to said cooling gas gas-collecting main and connected to each of the wind boxes underlying the sintering section. Both the cooling gas gas-collecting main and the sinter exhaust gas gas-collecting main are exhausted through a plurality of gas evacuating fans and flue connecting pipes to a flue.

7 Claims, 4 Drawing Figures

SINTERING WITH EXHAUST GAS PIPES

BACKGROUND OF THE INVENTION

The present invention relates to sintering plants for the sintering of fine grained iron ores and the like and specifically to the exhausting of gases from such plants.

It is known that fine grained iron ores must often be agglomerated into larger particles before they can be successfully used as a blast furnace feed. One method of effecting such agglomeration is to sinter the ore fines on a moving, continuous belt or grate. The mixture to be sintered is placed on the sintering machine, is ignited on its surface under an ignition hood and the ore is sintered as an oxygen-containing gas, usually air, is pulled through the mixture. As this air is pulled through the mixture, off-gases from the sintering process are caused to be exhausted to a point below the strand.

As sintering progresses, the combustion front moves progressively from the top of the mixture downward through the bed. When the front reaches the bottom of the grate, the sintering process is complete. This point is called the "burn-through" point. Subsequently it is necessary to cool the hot sinter. This cooling can be accomplished on the sinter machine itself, and for this purpose a cooling section may follow the sintering section.

As in the sintering section, air is pulled through the strand in the cooling section. The purpose of this air, rather than being to substain combustion, is to cool the sinter. Accordingly, it is found that air consumption per area unit in the sintering section and the cooling section differs. It is also found that there exists a variance in the permeability of the sinter bed between the sintering section and the cooling section. Additionally, while it is often considered advantageous to subject the off-gases from the sintering zone to a washing process in order to remove harmful substances from these gases, it may not be necessary to treat the cooling gases in this manner. It is, therefore, often advantageous to evacuate the gases from the sintering section and the cooling section through separate gas-collecting mains by means of separate gas evacuation fans.

From DE-AS 20 20 823 and DE-AS 23 21 213 it is known that exhaust gases from the sintering section from one side of the sintering belt can be drawn from one side of the sintering strand through wind boxes into a gas-collecting main arranged next to the sinter belt. These patents also disclose removing the dust generated in the sinter process in an electrostatic gas-cleaning system which is located at the feed end of the sintering machine, and to then lead the sintering section exhaust gases to a flue. The exhaust gas from the cooling section is also exhausted on one side from the wind boxes in the cooling section and is passed into a second gas-collecting main located next to the sinter machine. The dust is then removed in cyclones and the gas is brought into a flue located next to the sinter machine. For this process two flues are required and efficient gas evacuation, because of the unilateral means of exhaust, especially in the cooling section, is possible only with narrow sintering machines.

A similar process is described in British patent specification No. 1,427,089. There, the gas collecting mains are arranged in tandem and are exhausted in opposite directions. With this arrangement, either two flues or very long connecting lines to a single flue are required.

In U.S. Pat. No. 3,816,096 the option is presented of either connecting the last wind boxes of the sintering zone to the gas-collecting main of the cooling zone or the first wind boxes of the cooling zone to the gas collecting main of the sintering zone.

From U.S. Pat. No. 3,831,911 it is known to exhaust the exhaust gases of the cooling and the sintering sections unilaterally through two side-by-side gas-collecting mains, in which both gas-collecting mains run in the direction of the feed end of the sinter machine. In this design, the disadvantage of unilateral exhaust is also present.

From U.S. Pat. No. 2,441,383 it is known to exhaust the exhaust gases from the cooling and the sintering zones unilaterally into two gas-collecting mains located next to the sintering machine. One connecting pipe then leads from the centers of these gas-collecting mains to a fan and then to a flue. Here also the disadvantages associated with unilateral exhaust are present, and either two flues or excessively long gas mains are required. The object of the present invention is to provide a sintering plant where separate gas collecting systems are provided for the cooling section and for the sintering section and where gases are efficiently evacuated from the wind boxes while structural layout, space requirements, and accessibility are maintained at optimum conditions. The present invention allows such efficient evacuation by providing for the exhaust of the wind boxes underlying the cooling zone of the sinter machine from two sides of those wind boxes.

SUMMARY OF THE INVENTION

A cooling gas gas-collecting main is centrally arranged under the lower strand of the sintering machine's sintering belt and is connected, by way of a fan and a gas cleaning system located ahead of the feed end of the sinter machine, with a flue. The wind boxes below the sintering section are connected by connecting pipes to at least one sintering exhaust gas gas-collecting main. The gas-collecting main for the sinter exhaust gas is positioned adjacent the cooling gas gas-collecting main. The sinter exhaust gas gas-collecting main is also connected, by way of a gas cleaning system and fan located ahead of the feed end of the machine to the flue.

The cooling gas gas-collecting main is connected to the wind boxes underlying the cooling section by means of cooling gas connecting pipes which run from opposite sides of the wind boxes between the upper and lower strand of the sintering belt downwardly, and then inwardly where they connect with the aforementioned main. The material fines collected in the cooling gas gas-collecting main can be removed via discharge heads and sluices or by means of a scraper conveyor installed in the collecting main. If the latter option is chosen, the height of the sinter building can be kept lower. A multicyclone can be advantageously used as the gas-cleaning system for the off-gases from the cooling zone.

The sinter-exhaust connecting pipes from the wind boxes underlying the sintering section are run between the upper and lower strand to the outside, and then downwardly to the gas-collecting main for the sinter exhaust gas. The removal of the filtered out material fines can be accomplished in the same manner as is disclosed for use with the cooling gas gas-collecting main.

The gas-collecting mains are generally arranged on the same plane and adjacent to one another. It is also possible to connect the last wind boxes of the sintering section to the cooling gas gas-collecting main or to connect the first wind boxes of the cooling section to the sinter exhaust gas gas-collecting main when sintering conditions change. In general, an electrostatic gas-cleaning system is used for the sinter-exhaust gas, but a multi-cyclone may also be employed. Additionally, the gas streams from the cooling gas gas-collecting main and the exhaust gas gas-collecting main may be joined ahead of or inside the flue.

A preferred design provides for connecting the wind boxes underlying the sintering section by means of sinter exhaust connecting pipes to two sinter exhaust gas gas-collecting mains which are located on opposite sides of the sintering machine. By the use of this configuration, uniform exhaust of even wide sintering machines is possible. Furthermore, it is possible to exhaust in one of the two sinter exhaust gas gas-collecting mains that particular exhaust gas which contains the greatest amount of harmful gases. These harmful substances can then be washed out of the gas flow. This method is described in DE-AS 25 20 957, and a device for switching the wind boxes is described in DE-AS 26 12 831.

It is also advantageous to employ a multi-cyclone as the means of cleaning the gas in the cooling gas gas-collecting main and to install the multi-cyclone below the sintering section of the sintering machine. By virtue of such a design the sinter exhaust gas gas-collecting mains on the outside of the sinter machine building can run closer together.

Another advantageous design is to arrange the fans adjacent to one another in a common blower house so that only one crane is required for the maintenance of the fans. It also allows the fans to be efficiently wired.

Another advantageous design provides for full vertical assembly openings in the supporting frame next to the cooling section and behind the discharge end of the sintering belt. In this manner, the entire sintering building can be serviced with the main crane of the sintering building. In particular, all of the heavy crushing machines can be serviced with one main crane. Large installations can also be worked with two cranes without interference resulting.

Within the pipes connected to the fan on the delivery side, there may be installed scrubbers for washing out harmful gases. These scrubbers may be installed in one or both pipes when the sintering section is exhausted bilaterally. If necessary, another fan can be installed between the scrubber and the flue.

Finally, it may also be advantageous to install a collecting tray for grain dust and a scraper conveyor for the removal of grain dust between the lower strand and the cooling gas gas-collecting main. Such a design makes it possible to keep the overall height of the sintering plant low.

BRIEF DESCRIPTION OF THE DRAWINGS

The present invention is illustrated in the accompanying drawings, in which.

DESCRIPTION OF THE PREFERRED EMBODIMENT

Figure 1:
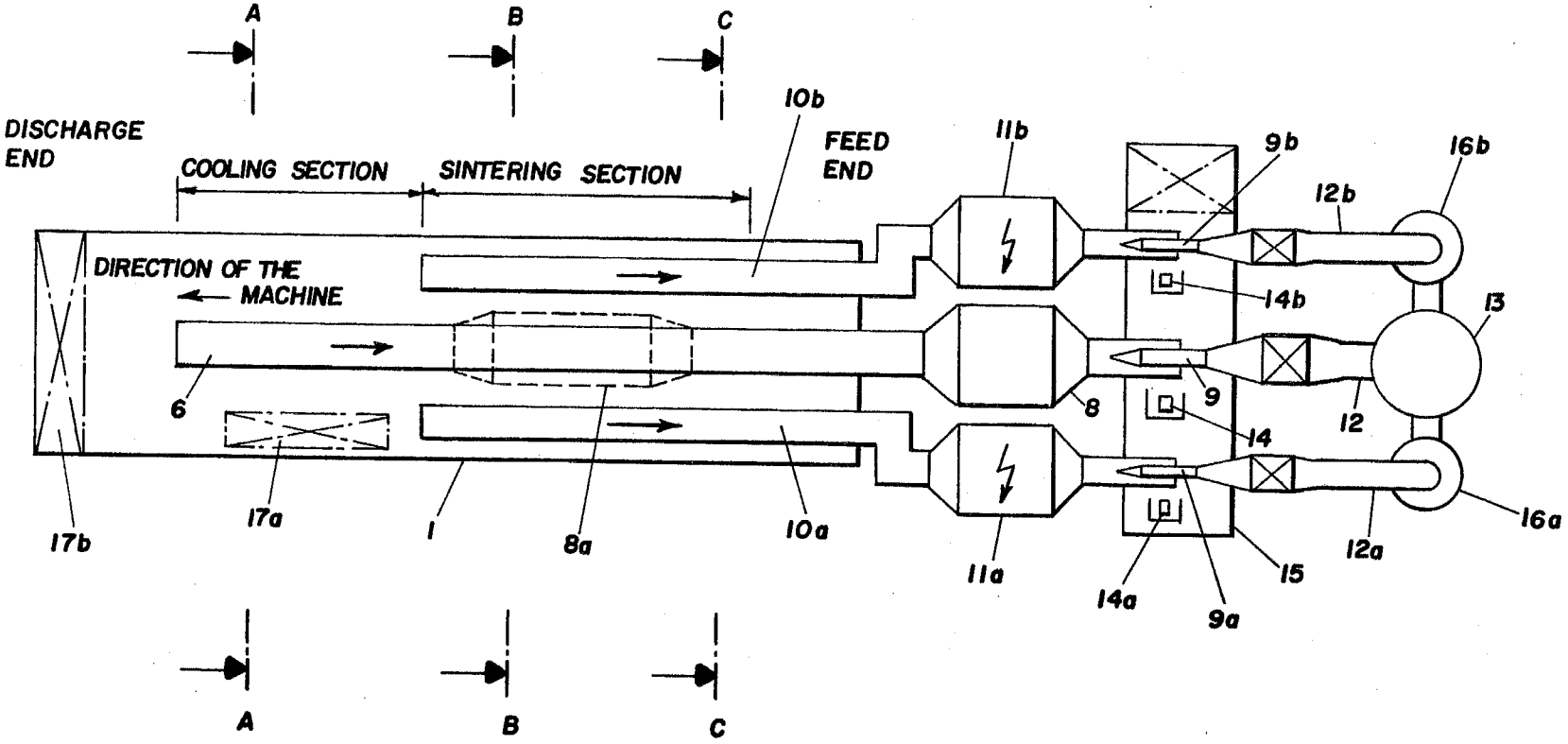
FIG. 1 is a schematic top view of a sintering plant, where for illustration purposes only the gas-collecting mains and the outline of the sintering building are shown.
Figure 2:
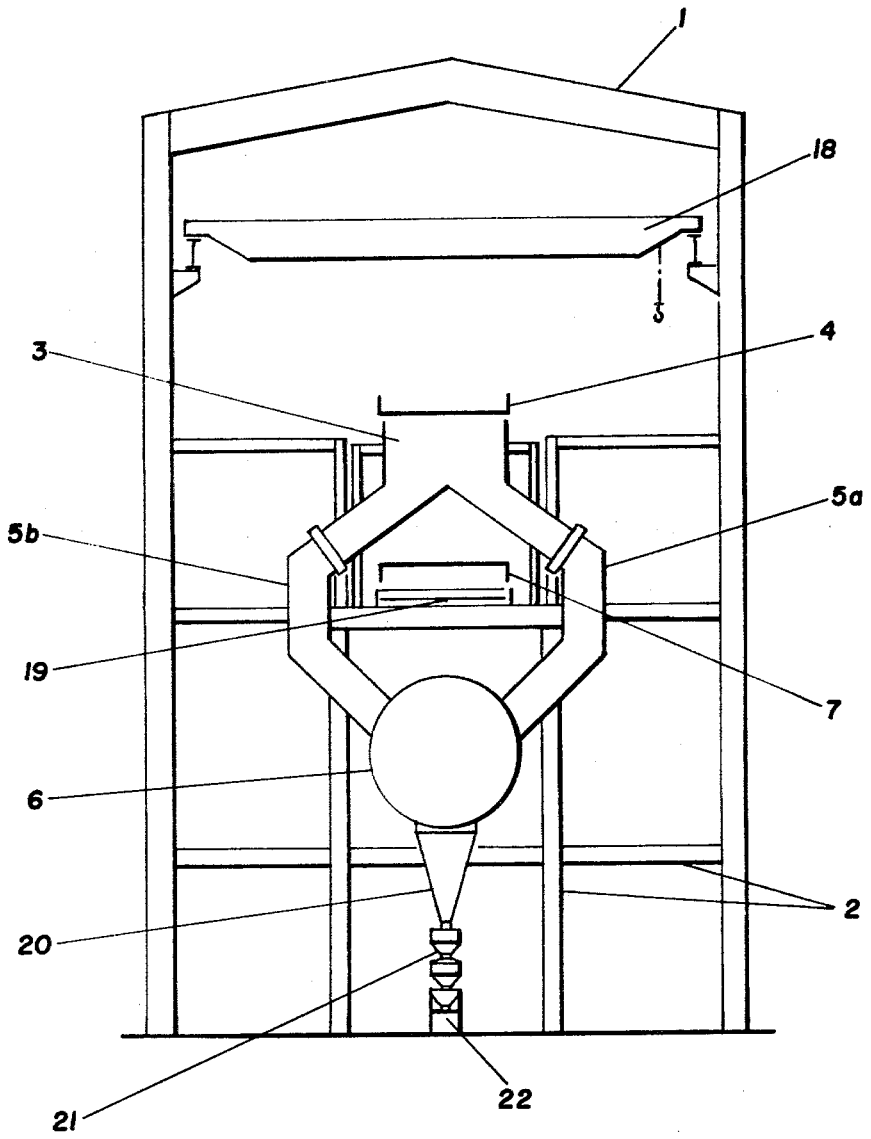
FIG. 2 is a vertical cross-section at line A—A in FIG. 1, through the cooling section of the sintering plant.
Figure 3:
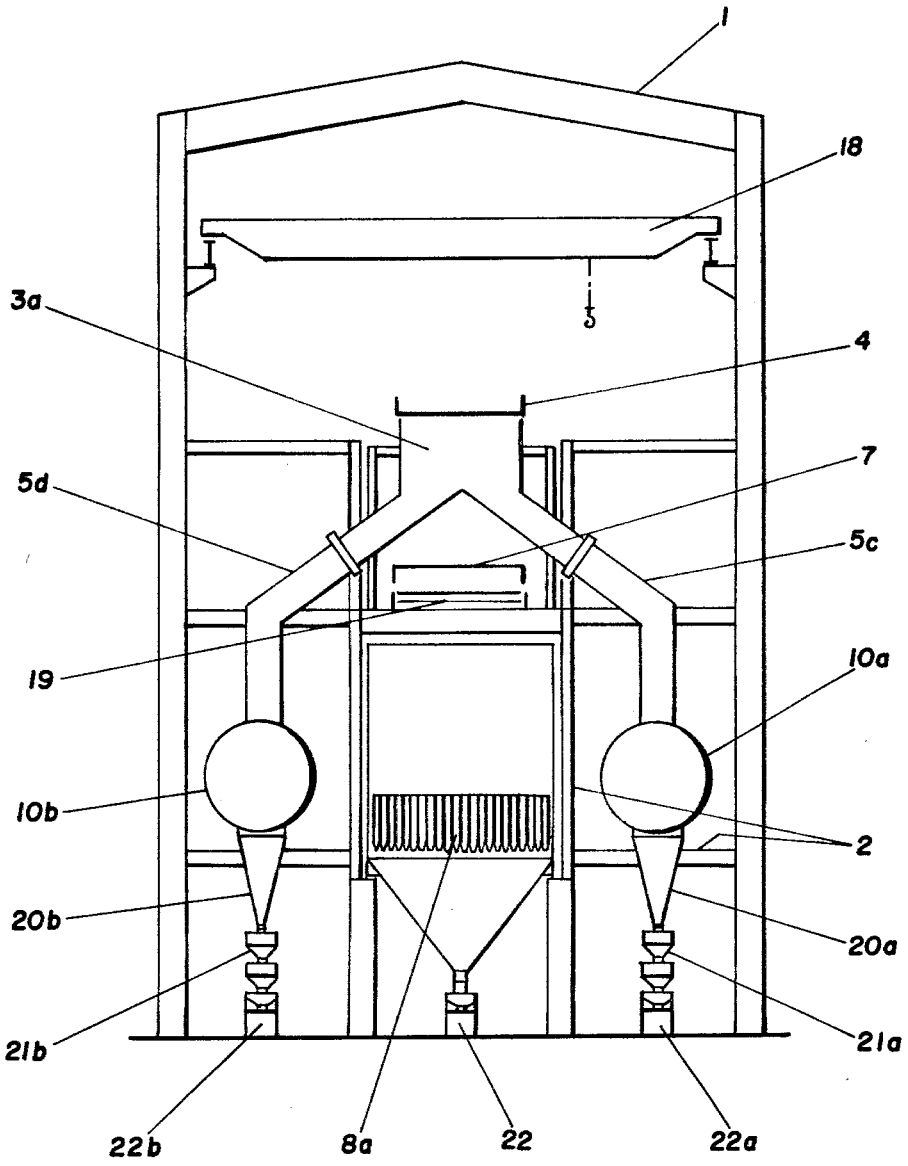
FIG. 3 is a vertical cross-section at line B—B in FIG. 1, through the sintering section of the sintering plant with a multi-cyclone installed therein.
Figure 4:
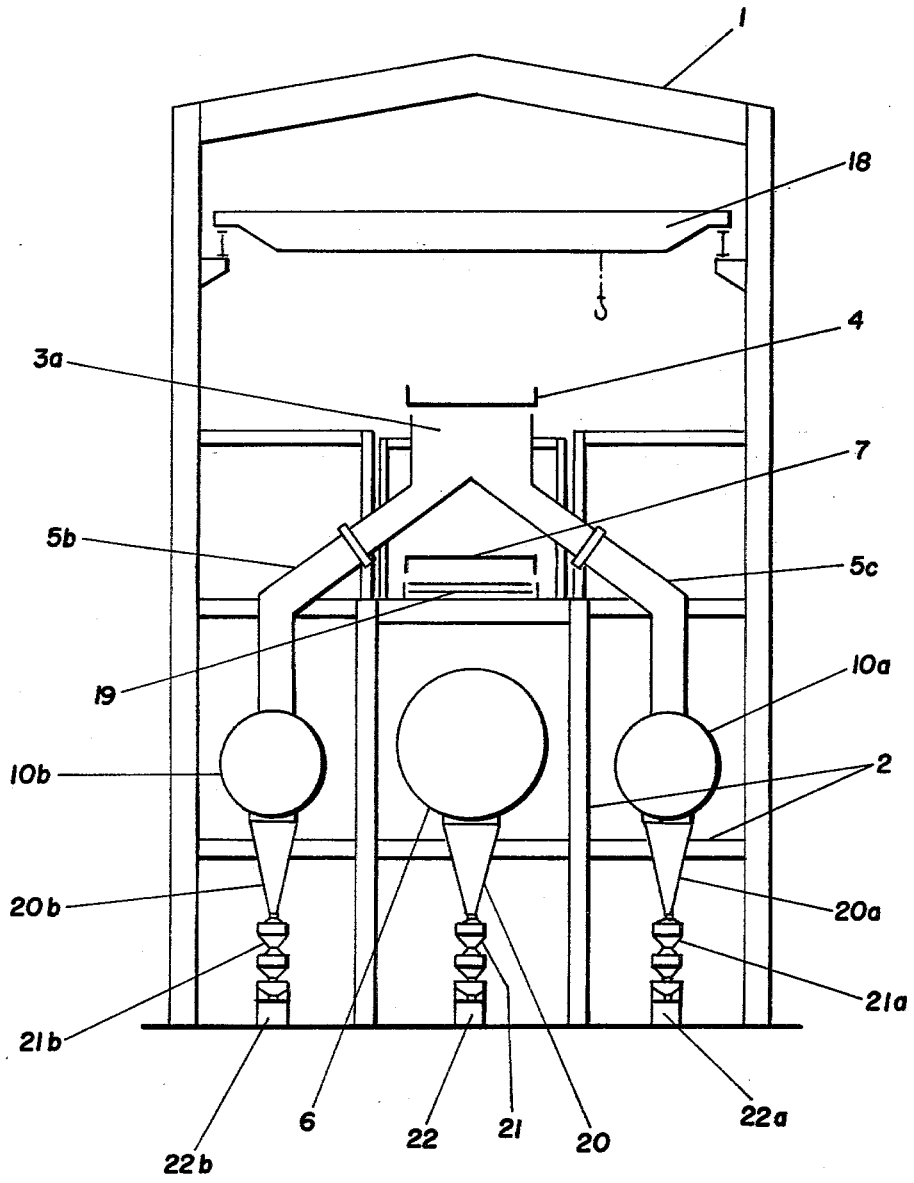
FIG. 4 is a vertical cross-section at line C—C in FIG. 1, through the sintering zone of the sintering plant.

Referring to FIGS. 1 through 4, in the sinter building 1 there is installed a supporting frame 2. Wind boxes 3 below the cooling section of the upper strand 4 of the sinter machine (FIG. 2) are bilaterally connected to the cooling gas gas-collecting main 6 with connecting pipes 5*a*, 5*b*. The cooling gas gas-collecting main 6 is centrally arranged below the lower strand 7, extends out of the sintering building 1 at the feed end of the sinter machine, ends in a multi-cyclone 8, and is connected with a fan 9.

The wind boxes 3*a*, below the sinter section of the upper strand 4 (FIG. 3), are bilaterally connected with the connecting pipes 5*c* and 5*d* to the sinter exhaust gas gas-connecting mains 10*a* and 10*b*, which are arranged laterally next to and below the lower strand 7. The sinter exhaust gas gas-collecting mains 10*a* and 10*b* also extend out of the sinter building 1 at the feed end of the sinter machine, terminate in electrostatic gas cleaning systems 11*a* and 11*b*, and are connected with fans 9*a* and 9*b*.

The fans 9, 9*a* and 9*b* are connected on the delivery side with flue 13 via pipes 12, 12*a* and 12*b*. A multi-cyclone 8*a* (shown in dotted lines) may be installed underneath the sintering zone. In this case multi-cyclone 8 is eliminated, and the gas collecting mains 10*a* and 10*b* can be installed closer together on the outside of the sintering building 1. Fans 9, 9*a* and 9*b*, together with their motors 14, 14*a* and 14*b*, are installed in a common blower house 15. Gas scrubbers 16*a* and 16*b* are provided ahead of the flue 13.

In the supporting frame 2 full vertical assembly openings 17*a* and 17*b* are arranged next to the cooling zone and behind the discharge end of the sinter machine, which can be serviced by the main crane 18 of the sinter building 1. Underneath the lower strand 7, a catch tray with a scraper conveyor 19 is provided to collect and remove scattered fines which fall off the lower strand 7. The discharge of material fines from the gas-collecting mains 6, 10*a* and 10*b* takes place via discharge heads 20, 20*a* and 20*b*, with the help of the discharge sluices 21, 21*a* and 21*b* onto conveyor belts 22, 22*a* and 22*b*. If scraper conveyors are provided in the gas-collecting mains 6, 10*a* and 10*b*, the overall height may be reduced accordingly. The accessibility of the plant is maintained at optimum conditions. Further, the entire dust filter assembly can be arranged centrally so that dust accumulates at only one point. Additionally, a single flue serves to evacuate both the sinter exhaust gas and the cooling gas, and condensation within the flue is prevented since the sinter exhaust gas is heated by the hot cooling gas. Such heating of the sinter exhaust avoids condensation.

Thus it will be seen that the objects of this invention are efficiently accomplished in that a bilateral exhaust of the wind boxes in the cooling zone as well as the sintering zone is possible while the structural layout, the space requirements, and the accessibility of the plant can be maintained at optimum conditions. The entire dust filter assembly can be arranged centrally so that dust accumulates at one point only. Further, only one common flue for the sinter exhaust gas and the cooling gas is required, and the sinter exhaust gas can be heated through the hot cooling gas so that condensation within the flue is prevented. Such heating is especially important when wet-cleaning of the gas is conducted. Finally, the entire space next to the cooling section remains free so that further extensions of the sintering machine can be facilitated.

We claim:

1. In a sintering plant for the sintering of fine grained iron ores and the like having a supporting frame; a straight sinter belt with an upper and a lower strand, said upper strand being divided into an initial sintering section and a succeeding cooling section; a plurality of wind boxes situated beneath the cooling section which remove cooling gas from the cooling section and a plurality of wind boxes situated beneath the sintering section which remove sinter exhaust gas from the sintering section; and a flue for the exhausting of cooling gas and sinter exhaust gas, the improvement comprising:

(a) a cooling gas gas-collecting main being centrally disposed beneath the lower strand and connected to each of the wind boxes underlying the cooling section by at least two cooling gas connecting pipes, said cooling gas connecting pipes attaching at opposite sides of the wind boxes underlying the cooling section, and connected through a plurality of gas evacuating fans and flue connecting pipes to the flue, and (b) two sinter exhaust gas gas-collecting mains being disposed on opposite sides of the cooling gas gas-collecting main and connected to each of the wind boxes underlying the sintering section by a plurality of sinter exhaust gas connecting pipes and connected through a plurality of gas evacuating fans and flue connecting pipes to said flue.

2. In the sintering plant defined in claim 1, the improvement wherein a gas cleaning means is situated between sinter exhaust gas-collecting mains and the flue.

3. In the sintering plant defined in claim 2, the improvement wherein a further gas cleaning means is situated between the cooling gas gas-collecting main and the flue.

4. In the sintering plant defined in claim 3, the improvement wherein the further gas cleaning means is a multi-cyclone which is situated beneath the sintering section of the sinter machine.

5. In the sintering plant defined in claim 1, the improvement wherein the gas evacuating fans are arranged side by side in a common blower house.

6. In the sintering plant defined in claim 1, the improvement wherein there are gas scrubbers inside the flue connecting pipes.

7. In the sintering plant defined in claim 1, the improvement wherein there is a catch tray for scattered fines and a scraper for the removal of fines between the lower strand and the cooling gas gas-collecting main.

* * * * *